US012618401B1

(12) United States Patent
Chen et al.

(10) Patent No.: US 12,618,401 B1
(45) Date of Patent: May 5, 2026

(54) DIAPHRAGM ASSEMBLY AND DIAPHRAGM PUMP

(71) Applicant: ZHEJIANG ELE SMART TECHNOLOGY CO., LTD., Wenzhou (CN)

(72) Inventors: Hao Chen, Wenzhou (CN); Zhiyong Xu, Wenzhou (CN)

(73) Assignee: ZHEJIANG ELE SMART TECHNOLOGY CO., LTD., Wenzhou (CN)

( * ) Notice: Subject to any disclaimer, the term of this patent is extended or adjusted under 35 U.S.C. 154(b) by 0 days.

(21) Appl. No.: 19/015,541

(22) Filed: Jan. 9, 2025

(30) Foreign Application Priority Data

Nov. 4, 2024 (CN) ..... 202411559039.7

(51) Int. Cl.
*F04B 43/00* (2006.01)

(52) U.S. Cl.
CPC ..... *F04B 43/0054* (2013.01); *F04B 43/0009* (2013.01); *F04B 43/0045* (2013.01); *F04B 43/0063* (2013.01)

(58) Field of Classification Search
CPC F04B 43/0054; F04B 43/009; F04B 43/0045; F04B 43/0063; F04B 43/026
USPC ..... 92/99–101
See application file for complete search history.

(56) References Cited

U.S. PATENT DOCUMENTS

| | | | | |
|---|---|---|---|---|
| 2,230,595 | A * | 2/1941 | Horton | B60C 23/14 92/100 |
| 4,610,605 | A * | 9/1986 | Hartley | F04B 53/1065 92/48 |
| 5,743,169 | A * | 4/1998 | Yamada | B29C 45/14467 92/99 |
| 6,514,177 | B1 * | 2/2003 | Brugger | F04B 43/0054 482/13 |
| 2016/0108903 | A1 * | 4/2016 | Cai | F04B 43/14 417/273 |
| 2024/0141883 | A1 * | 5/2024 | Kinna | F04B 43/026 |

FOREIGN PATENT DOCUMENTS

DE 202022106243 U1 * 12/2022 ..... F04B 53/22

* cited by examiner

*Primary Examiner* — Charles G Freay
(74) *Attorney, Agent, or Firm* — Chen Yoshimura LLP

(57) ABSTRACT

A diaphragm assembly includes a piston push block, a diaphragm, a middle piece, a balance wheel seat, and fasteners. The diaphragm includes a diaphragm body with protrusions which protrude toward the middle piece and extends into the balance wheel seat. The piston push block includes a piston head and a piston shaft. The piston head is located on the side of the diaphragm facing away from the middle piece, and the piston shaft extends towards the diaphragm and is embedded in the diaphragm protrusion. The middle piece includes a first through hole, the balance wheel seat includes a balance wheel, and the balance wheel includes an insertion hole for the corresponding diaphragm protrusion to be inserted in. The fastener fixes the piston push block, the diaphragm and the balance wheel seat from the side facing away from the working surface of the diaphragm.

17 Claims, 9 Drawing Sheets

DIAPHRAGM ASSEMBLY AND DIAPHRAGM PUMP

BACKGROUND OF THE INVENTION

This invention relates to the field of diaphragm pumps, and in particular to a diaphragm assembly and a diaphragm pump employing the diaphragm assembly.

The diaphragm is one of the core components of the diaphragm booster pump. The motor of the diaphragm booster pump drives an eccentric cam to rotate, so as to drive the balance wheel seat and the balance wheel on it to swing up and down. The diaphragm is elastically deformed with the swing of the balance wheel, so that the volume of the booster chamber at the working surface of the diaphragm changes. The volume change is used to complete the process of water absorption and drainage.

In the related art, the diaphragm of the diaphragm assembly and its related structures have the problem of poor sealing performance.

SUMMARY OF THE INVENTION

An object of the present invention is to solve at least one aspect of the above-mentioned problems and defects in the related art.

In response to the above problems, the present invention provides a diaphragm assembly, which includes a piston push block, a diaphragm, a middle piece, a balance wheel seat, and fasteners, wherein the diaphragm includes a diaphragm body and a protrusion arranged on the diaphragm body, wherein the protrusion protrudes in the direction toward the middle piece and extends into the balance wheel seat; the piston push block includes a piston head and a piston shaft arranged on the side of the piston head closer to the diaphragm, the piston head is located on the side of the diaphragm facing away from the middle piece, the piston shaft extends towards the diaphragm, and the piston shaft is embedded in the corresponding diaphragm protrusion; the middle piece has a first through hole, the balance wheel seat has a balance wheel, and the balance wheel has an insertion hole for the corresponding diaphragm protrusion to be inserted in; and the fastener affixes the piston push block, the diaphragm and the balance wheel seat from the side facing away from the working surface of the diaphragm.

In some embodiments, the diaphragm protrusion has a second through hole at its end, a first threaded hole is provided inside the piston shaft, and the fastener is configured to pass through the second through hole and connect with the first threaded hole.

In some embodiments, the piston head has a first annular protruding strip arranged around the piston shaft on the side facing the diaphragm. The first annular protruding strip can prevent liquid from entering the diaphragm protrusion from the radial direction of the piston shaft, thereby improving the sealing effect.

In some embodiments, the outer side of the piston shaft has a second annular protruding strip, which can prevent liquid from entering the non-working area from the axial direction of the piston shaft, thereby further improving the sealing effect.

In some embodiments, the outer diameters of the piston shaft and the diaphragm protrusion gradually decrease along their extension directions. The piston shaft and the diaphragm protrusion are conical in shape in the axial direction, and cooperate with the conical surface of the insertion hole.

Under the constraint of the axial force, the conical surface will gradually press the diaphragm to achieve sealing.

In some embodiments, the diaphragm protrusion is a structure without holes, the balance wheel seat further includes a second threaded hole, the fastener includes a claw structure and screws, the claw structure is configured to pass through the insertion hole and clamp the diaphragm protrusion, and the screws are configured to compress the claw structure toward the center when being screwed into the second threaded hole. The lack of holes in the diaphragm completely isolates the diaphragm chamber and the motor at the non-working surface to avoid liquid leakage. In addition, since the diaphragm itself has no gaps, it can automatically suck in the medium (fluid) in the absence of the medium, so that the diaphragm pump can run dry for a short period of time.

In some embodiments, the piston shaft and the diaphragm protrusion are shaped in an extending direction such that the middle portion is smaller in diameter and the ends are larger in diameter.

In some embodiments, a protruding part is formed on the surface of the piston head on the side facing the diaphragm, and a recesses is formed on the surface of the diaphragm body. The protruding part cooperates with the recess and to prevent rotation of the piston push block.

In some embodiments, the surface of the piston head has two grooves configured to allow a tool to clamp the piston push block.

In some embodiments, a gasket is provided between the middle piece and the balance wheel seat, and a third through hole is provided on the gasket for the diaphragm protrusion to be inserted.

In some embodiments, the cross section of the diaphragm protrusion is a non-circular cross section.

In some embodiments, the diaphragm body comprises a disk, and the diaphragm protrusion is located at a position on the disk that deviates from the center and closer to the edge. The eccentric setting and the cooperation of the piston valve body can increase the flow area of the liquid.

In some embodiments, the thickness of a portion of the diaphragm contacting the edge of the first through hole is greater than the thickness of the remaining portion of the diaphragm. The increased thickness of the diaphragm at the contact portion can offset the impact of contact friction and increase the life of the diaphragm.

In some embodiments, the edge of the first through hole of the middle piece is provided with a step, and the diaphragm assembly further includes a gasket, which is arranged on the step and is made of a polytetrafluoroethylene material. The gasket provides lubrication between the diaphragm and the middle piece to increase the life of the diaphragm.

In some embodiments, the diaphragm body and the diaphragm protrusion are integrally formed, and the diaphragm is made of elastic material.

In some embodiments, the piston push block is made of nylon and glass fiber materials.

In another aspect, the present invention provides a diaphragm pump, which includes a pump head cover, a piston valve body, an eccentric cam, a motor and a diaphragm assembly according to any of the embodiments described above, wherein the eccentric cam is installed in the diaphragm assembly, and the motor is connected to the eccentric cam and drives the eccentric cam to rotate.

In the aforementioned exemplary embodiments of the present application, compared with the prior art, a piston push block is provided on the working surface of the diaphragm, and the piston head of the piston push block abuts the diaphragm body, while the piston shaft of the piston push block is inserted in the protrusion of the diaphragm. The fastener is inserted from the right side of the insertion hole of the balance wheel seat, and fixes the piston push block, the diaphragm, and the balance wheel seat. The fastener is located on the non-working surface of the diaphragm, so it does not need to contact the liquid, which minimizes the risk of rust or corrosion of the screws. In this way, liquid can be prevented from leaking into the non-working area of the diaphragm, thereby improving the safety and life of the diaphragm pump.

BRIEF DESCRIPTION OF DRAWINGS

Embodiments of the present invention are described with reference to the following drawings. Other objectives, details, features, and advantages of the embodiments will also become clearer from the detailed descriptions. Embodiments of the present invention are described as examples and are not limiting.

DETAILED DESCRIPTION OF THE INVENTION

Embodiments of the present invention are described in detail below with reference to the drawings. In the specification and drawings, like features are designated by like reference symbols. The descriptions below should be taken as explanations of the overall inventive concept of the present invention and should not be construed as a limitation on the present invention.

In the descriptions below, terms such as "including" are intended to be open-ended and mean "including without limitation", and may include other contents. "Based on" means "at least partly based on." "An embodiment" means "at least one embodiment." "Another embodiment" means "at least another embodiment," etc.

Figure 1:
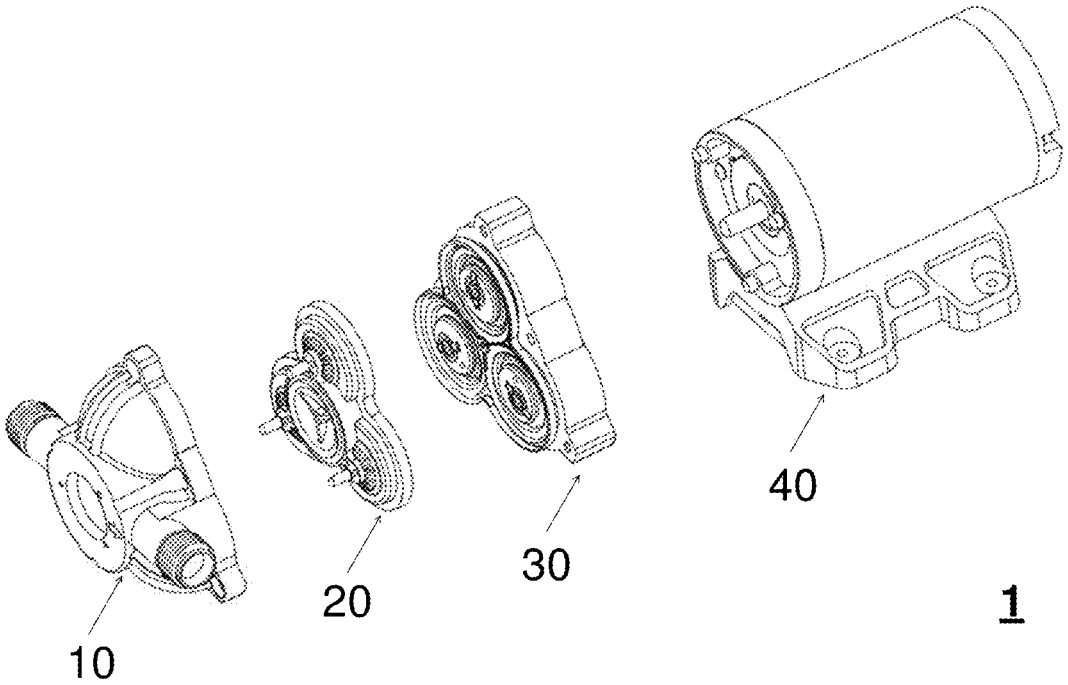
FIG. 1 is a perspective exploded view of a diaphragm pump 1 according to an embodiment of the present invention.

FIG. 1 is a perspective exploded view of a diaphragm pump 1 according to an embodiment of the present invention. The diaphragm pump 1 includes a pump head cover 10, a piston valve body 20, a diaphragm assembly 30 and a base 40. The pump head cover 10 has a fluid inlet and a fluid outlet. The piston valve body 20 is also referred to as a fluid displacement pressure plate. The diaphragm assembly 30 is arranged on the base 40. The piston valve body 20 and the diaphragm on the outside of the diaphragm assembly 30 form a working area of the diaphragm, and the side where the working area is located is the working surface of the diaphragm. A motor is arranged in the base 40. The rotation of the motor of the diaphragm pump 1 drives the balance wheel in the diaphragm assembly 30 to swing, which causes the diaphragm in the diaphragm assembly 30 to undergo elastic deformation, so that the volume of the boosting chamber changes, thereby realizing the boosting function.

The structure or assembly method of each component in the diaphragm assembly will affect the sealing of the diaphragm and the service life of the diaphragm pump. The inventors have discovered that sealing may be achieved by using screws to pass through the diaphragm from the working surface of the diaphragm to connect it to the balance wheel seat. However, because the screws are in direct contact with the liquid, there is a risk of rust or corrosion during long-term use, resulting in a gap between the screws and the diaphragm, causing liquid to leak into the non-working area of the diaphragm, and ultimately causing the diaphragm pump to fail.

In order to solve the above problems, embodiments of the present invention provide a diaphragm assembly and a diaphragm pump, wherein the diaphragm assembly includes a piston push block, a diaphragm, a middle piece, a balance wheel seat, and a fastener, wherein the diaphragm includes a diaphragm body and a protrusion arranged on the diaphragm body, the protrusion protrudes toward the middle piece and extends into the balance wheel seat; the piston push block includes a piston head and a piston shaft arranged on the side of the piston head closer to the diaphragm, the piston head is located on the side of the diaphragm facing away from the middle piece, the piston shaft extends toward the diaphragm, and the piston shaft is embedded in the corresponding diaphragm protrusion; the middle piece is provided with first through holes, the balance wheel seat includes a balance wheel, and the balance wheel is provided with an insertion hole for the corresponding diaphragm protrusion to be inserted; and the fastener is configured to affix the piston push block, the diaphragm and the balance wheel seat from the side facing away from the working surface of the diaphragm.

Figure 2:
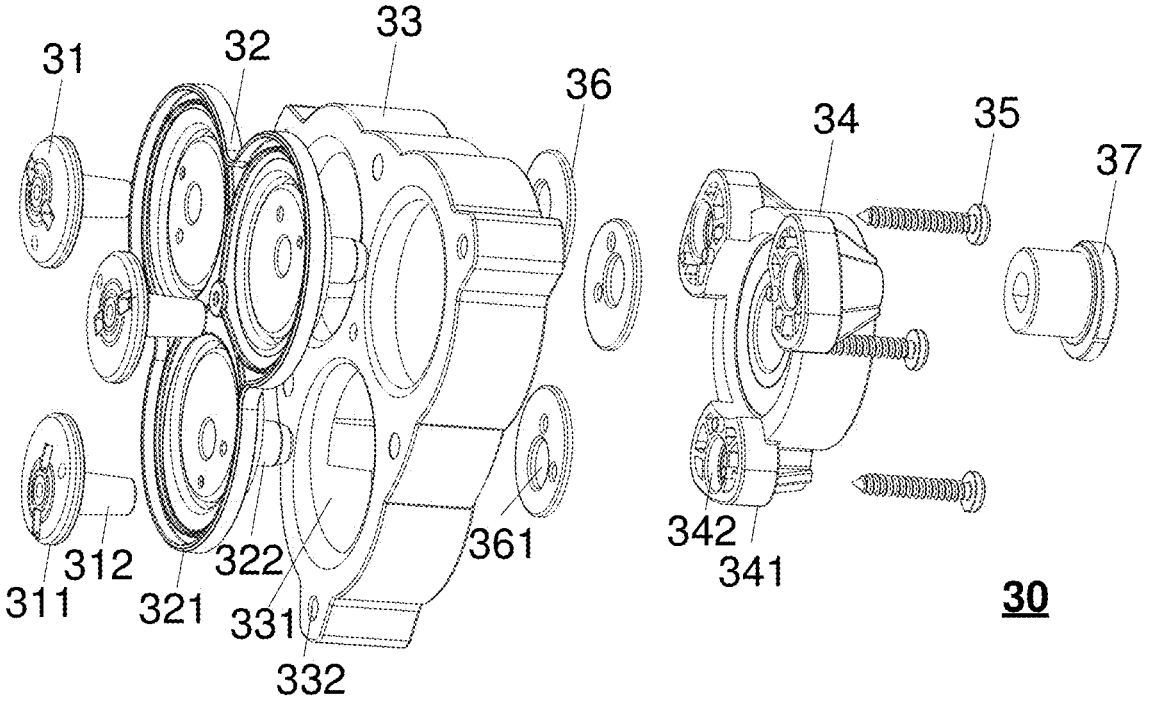
FIG. 2 is a perspective exploded view of a diaphragm assembly 30 according to an embodiment of the present invention.

FIG. 2 is a perspective exploded view of a diaphragm assembly 30 according to an embodiment of the present invention. As shown in FIG. 2, the diaphragm assembly 30 includes three piston push blocks 31, a diaphragm 32, a middle piece 33, a balance wheel seat 34 and three fasteners 35, arranged from the pump head to the pump tail, that is, from left to right in the figure.

Each piston push block 31 includes a piston head 311 and a piston shaft 312. The piston head 311 is located on the side of the diaphragm 32 facing away from the middle piece 33, that is, the left side of the diaphragm 32 in the figure. The piston shaft 312 is on the side of the piston head 311 closer to the diaphragm 32. The piston shaft 312 extends from the piston head 311 toward the diaphragm 32. In FIG. 2, the piston head 311 is circular disk shaped, and in some other examples, the piston head 311 may also be other suitable shapes, such as square, rectangular, oval, etc.

The diaphragm 32 includes a diaphragm body 321 and three protrusions 322. In the example of FIG. 2, the diaphragm body 321 includes three disks, and its shape is approximately a triangle formed by three disks arranged as three vertices, and there are three corresponding diaphragm chambers in the working area. Viewed from the side of the piston valve body 20, each diaphragm protrusion 322 is a recess; viewed from the side of the base 40, each diaphragm protrusion 322 is a protrusion.

Three diaphragm protrusions 322 are provided on the diaphragm body 321. Each diaphragm protrusion is located in its own disk, and protrudes toward the direction of the middle piece 33 and extends into the balance wheel of the balance wheel seat 34. The sizes of the recesses of the diaphragm protrusions 322 match the sizes of the piston shafts 312. Each piston shaft 312 is embedded in the recesses of the corresponding diaphragm protrusion 322. In some examples, the inner size of each diaphragm protrusion 322 (such as the inner diameter, for example, 8 mm) may be slightly smaller than the outer size of the piston shaft 312 (such as the outer diameter) to provide an interference fit. The position of each diaphragm protrusion 322 may be eccentric relative to the corresponding disk, i.e., the diaphragm protrusion may be located at a position that deviates from the center of the corresponding disk and is closer to the outer edge of the diaphragm 32. This arrangement and its cooperation with the piston valve body may increase the flow area of the liquid.

The diaphragm body 321 and the diaphragm protrusions 322 may be integrally formed. In some examples, the diaphragm 32 may be made of a rubber material, or other materials with appropriate elasticity, such as polyurethane. The rubber material here may be ordinary rubber or special rubber, such as fluororubber. The material of the diaphragm should adapt to the requirements of different media in the pump (such as corrosive pesticides) to provide a safe and stable operating environment. The material of the piston push block may be different from the material of the diaphragm. The piston push block may be made of a composite reinforced material, such as a composite material of nylon and glass fiber, to increase its impact strength.

The middle piece 33 is a support member for the diaphragm assembly 30. The middle piece 33 is provided with three equally spaced through holes 331 (first through holes). The balance wheel seat 34 is provided with three balance wheels 341. The surrounding walls of the middle piece 33 and the diaphragm 32 form three swing chamber for the balance wheel to swing. Each balance wheel 341 is provided with an insertion hole 342 for the corresponding diaphragm protrusion 322 of the diaphragm to plug in. Each fastener 35 passes through the corresponding insertion hole 342 in the direction toward the pump head to fix the corresponding piston push block 31 and the diaphragm 32 to the corresponding balance wheel 341.

The middle piece is provided with fixing holes 332 distributed evenly around its periphery. These fixing holes 332 may cooperate with fixing holes (not shown) on the pump head cover 10 to fix the pump head cover 10 and the diaphragm assembly 30 together.

In FIG. 2, the piston push block is provided on the working surface of the diaphragm 32, and the piston head of the piston push block abuts the diaphragm body, while the piston shaft of the piston push block is embedded in the diaphragm protrusion of the diaphragm. The fasteners are inserted from the right side of the insertion hole of the balance wheel seat, to affix the piston push block, the diaphragm and the balance wheel seat together. The fasteners are located on the non-working surface of the diaphragm, so they do not need to contact the liquid, and there is minimal risk of rust or corrosion of the screws. This prevents the liquid leaking into the non-working area of the diaphragm (such as the motor part), thereby improving the safety and life of the diaphragm pump.

In the diaphragm assembly 30, the numbers of the piston push blocks 31, the disks on the diaphragm 32, the through holes 331 on the middle piece 33, the balance wheels 341 on the balance wheel seat 34, and the fasteners 35 are corresponding to and consistent with each other. It should be understood that in some other examples, according to actual application requirements, the number of the disks on the diaphragm body may be other numbers, such as 1, 4, 5 or 6, and the corresponding numbers of the piston push blocks, the through holes on the middle piece, the balance wheels on the balance wheel seat, and the fasteners may be 1, 4, 5 or 6.

In some examples, a plurality of gaskets 36 may be provided between the middle piece 33 and the balance wheel seat 34. In the example of FIG. 2, each gasket 36 is provided with an assembly hole 361 (third through hole) to allow the diaphragm protrusion 322 to pass therethrough. The gaskets 36 abut the side of the diaphragm 32 facing the balance wheel seat 34. The gaskets may be made of a metal material, such as stainless steel. The balance wheel seat 34 will drive the diaphragm 32 to move together during long-term rotation, and the contact surface between the two will experience fatigue wear after long-term use, thereby causing fatigue damage on the diaphragm 32. The gaskets 36 between the middle piece 33 and the balance wheel seat 34 may lessen the wear.

Figure 3A:
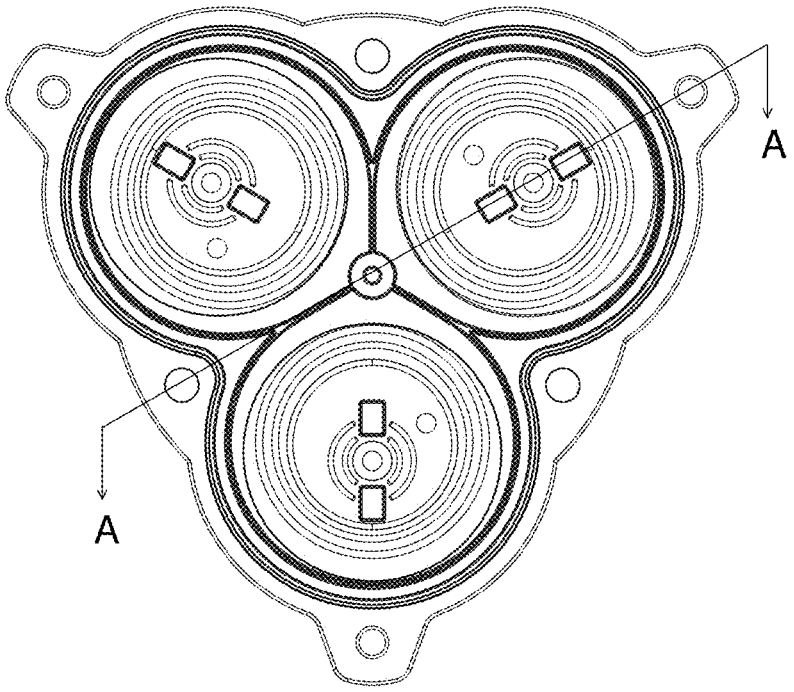
FIG. 3*a* is a front plan view of the assembled diaphragm assembly 30 according to an embodiment of the present invention.
Figure 3B:
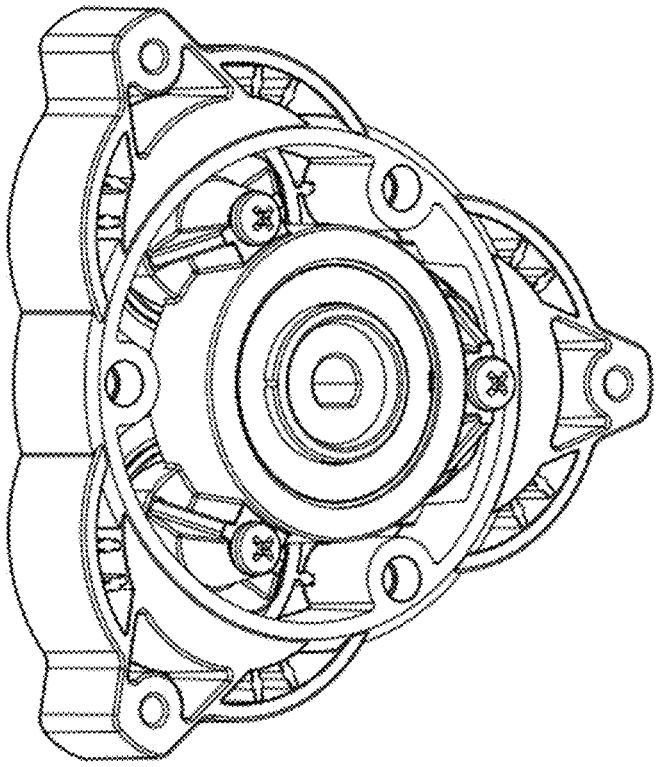
FIG. 3*b* is a perspective view of the assembled diaphragm assembly 30 according to an embodiment of the present invention.

In some examples, an eccentric cam 37 may be provided in the diaphragm assembly 30. FIG. 3*a* is a front plan view of the assembled diaphragm assembly 30, showing the front of the diaphragm assembly 30. FIG. 3*b* is a perspective view of the assembled diaphragm assembly 30, showing the back of the diaphragm assembly 30.

The assembly process of the diaphragm assembly 30 may be as follows: The balance wheel seat 34 is assembled on the middle piece 33, and the balance wheels 341 is extend into the swing chambers of the middle piece and then fix them. Each diaphragm protrusion 322 on the diaphragm 32 is aligned with the insertion hole 342 of the corresponding balance wheel 341, and the diaphragm 32 and the balance wheel 341 are pressed tightly against each other. After aligning each piston push block 31 with the diaphragm protrusion 322, the piston head 311 is pushes to insert the piston shaft 312 into the diaphragm protrusion 322. Each fastener 35 is inserted into the corresponding insertion hole 342 of the balance wheel, and finally the piston push block, diaphragm, and balance wheel seat are fixed together.

In some examples, the inventor found that when the piston head of the piston push block is set inside the diaphragm, because the piston push block and the diaphragm are made of different materials, manufacturing and assembly are difficult, and parts are prong to slippage during use, causing the internal connection of the diaphragm assembly to be unstable and even leading to failures. In embodiments of the present invention, the diaphragm assembly 30 includes separately provided piston push block and the diaphragm, and the manufacturing and assembly process is very simple. In addition, the piston shafts are embedded in the inside of the diaphragm protrusions, the position between the piston push blocks and the diaphragm is easier to fix, and the structure is more stable and reliable.

Figure 4A:
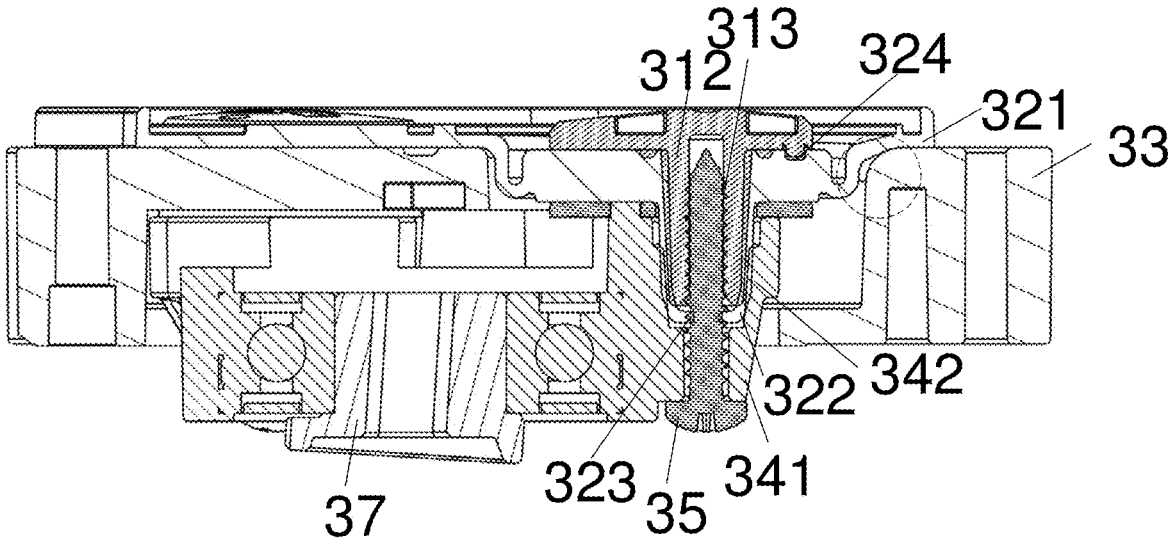
FIG. 4*a* is a cross-sectional view of the diaphragm assembly 30 of FIG. 3*a* taken along the line AA.
Figure 4B:
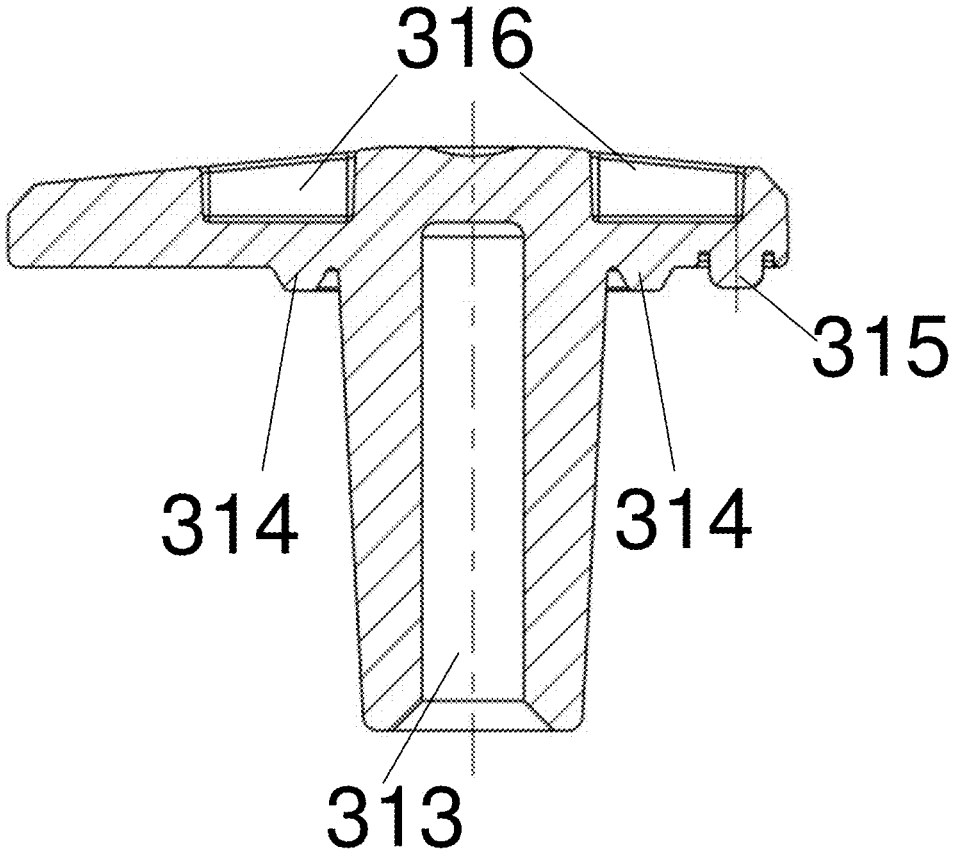
FIG. 4*b* is a cross-sectional view of the piston push block of FIG. 4*a*.
Figure 4C:
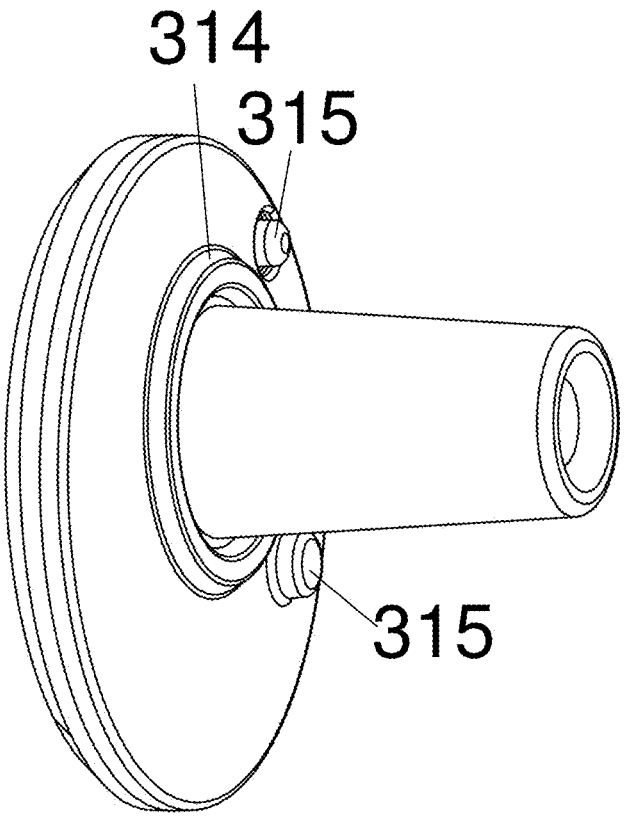
FIG. 4*c* is a perspective view of the piston push block of FIG. 4*a*.

FIG. 4*a* shows a cross-sectional view of the diaphragm assembly 30 in FIG. 3*a* taken along the AA direction. FIG. 4*b* shows a cross-sectional view of the piston push block in FIG. 4*a*, and FIG. 4*c* shows a perspective view of the piston push block in FIG. 4*a*. In FIG. 4*a*, a through hole 323 (a second through hole) is provided at the end of the diaphragm protrusion 322 of the diaphragm. A threaded hole 313 (a first threaded hole) is provided inside the piston shaft 312 of the piston push block. The fastener 35 passes through the through hole 323 and is connected to the internal threaded hole 313 of the piston shaft 312. In the assembly of the diaphragm assembly 30, the fastener 35 first enters the balance wheel through the insertion hole in the balance wheel, and then connects to the internal threaded hole 313 of the piston shaft 312 via the through hole 323. In FIG. 4*a*, the shoulder of the fastener 35 abuts against the bottom surface of the balance wheel 341, which may improve the connection strength.

In FIG. 4*a*, the connections between the piston shaft 312 and the diaphragm protrusion 322, and between the diaphragm protrusion 322 and the insertion hole 342 may both be interference connections. Specifically, the inside of the insertion hole 342, the inside and outside of the diaphragm protrusion 322, and the outside of the piston shaft 312 may all be straight cylindrical shapes. In addition, the outer diameter of the diaphragm protrusion is slightly larger than the inner diameter of the insertion hole 342, and the inner diameter of the diaphragm protrusion is slightly smaller than the outer diameter of the piston shaft. In some other examples, the shapes of the diaphragm protrusion 322 and the piston shaft 312 may be other than straight cylindrical. For example, as shown in FIGS. 4*b* and 4*c*, the outer diameter of the piston shaft may gradually decrease in its direction of extension. In addition, the outer diameter of the diaphragm protrusion may also gradually decrease along its extension direction. The piston shaft and the diaphragm protrusion are conical in shape in the axial direction, and can cooperate with the conical surface of the insertion hole. Under the constraint of the axial force, the conical surface will gradually press the diaphragm to achieve sealing. In addition, the length of the piston shaft 312 and the length of the diaphragm protrusion 322 may be equal or approximately equal, for example, both may be 12 mm.

According to FIG. 4*a*-4*c*, the shoulder of the piston push block 31, i.e. the surface of the piston head 311 facing the diaphragm 32, is provided with an annular protruding strip 314 (first annular protruding strip), which is arranged around the piston shaft 312. When the piston push block 31 is pushed into the diaphragm protrusion 322, the annular protruding strip 314 is embedded in the diaphragm body 321. The annular protruding strip 314 can prevent liquid from entering the diaphragm protrusion 322 from the radial direction of the piston shaft 312, thereby improving the sealing effect.

In addition, two protruding parts 315 are provided on the back side of the piston push block 31, that is, on the side of the piston head 311 facing the diaphragm 32. Correspondingly, two recesses 324 are provided on the surface (working surface) of the diaphragm body 321. The two protruding parts 315 and the two recesses 324 cooperate with each other. When the piston push block 31 is pushed into the diaphragm protrusion 322, each protruding part 315 may be aligned with the corresponding recess 324 and pressed into it. The protruding parts 315 and the recesses 324 function to prevent the rotation of the piston push block 31. It should be understood that the number of protruding parts or recesses is not limited to the case of 2 in the figure, and may be specifically set according to actual conditions.

In addition, two grooves 316 are provided on the front side of the piston push block 31, that is, the side facing away from the diaphragm 32. When the piston push block 31 needs to be pushed into the diaphragm 32, the grooves 316 may be clamped by an external clamping tool to facilitate the assembly of the pump.

Figure 4D:
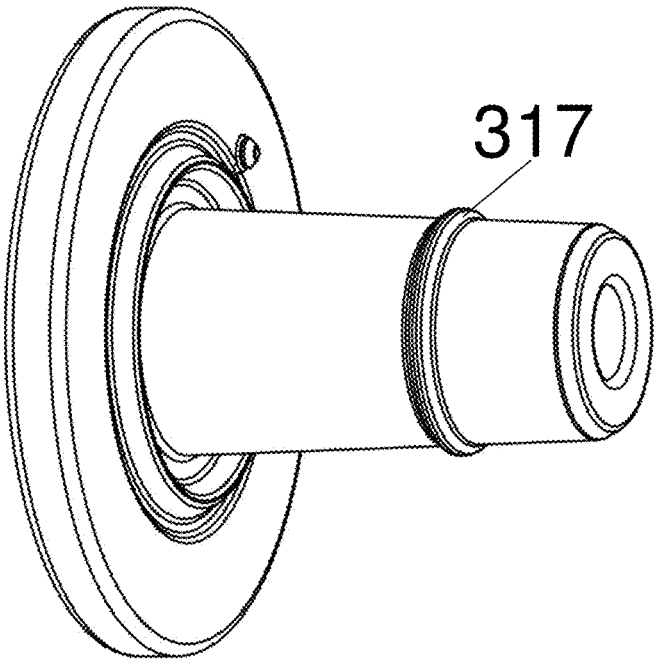
FIG. 4*d* is a perspective view of a piston push block according to an embodiment of the present invention.

FIG. 4*d* shows a perspective view of a piston push block in an embodiment of the present invention. Compared with FIG. 4*c*, an annular protruding strip 317 (second annular protruding strip) is provided on the outer side of the piston shaft of the piston push block in FIG. 4*d*. The annular protruding strip 317 can prevent liquid from entering the non-working area from the axial direction of the piston shaft 312, further improving the sealing effect.

Figure 4E:
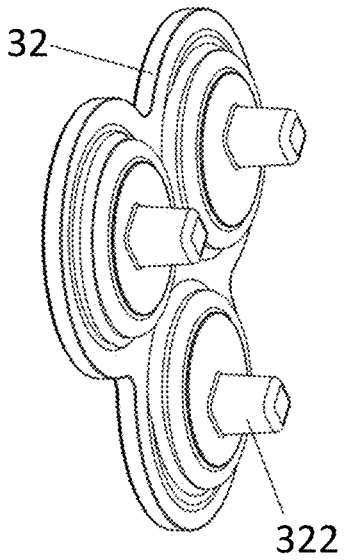
FIGS. 4*e* and 4*f* are perspective and side views, respectively, of a diaphragm according to an alternative embodiment of the present invention.
Figure 4F:
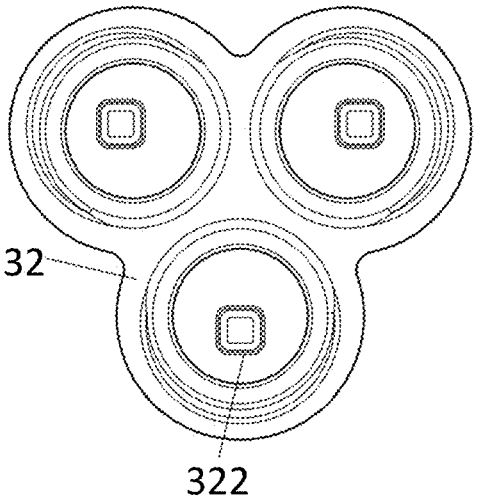

In addition, the diaphragm protrusion 322 on the diaphragm 32 has a circular cross section, which is convenient for the diaphragm protrusion 322 to be inserted into the insertion hole 331 on the balance wheel seat 33. In some examples (see, e.g., FIGS. 4*e* and 4*f*), the diaphragm protrusion 322 on the diaphragm 32 has a non-circular cross section. Specifically, the cross section of the diaphragm protrusion 322 may be square, rectangular, elliptical or other shapes, which may effectively reduce the rotation of the diaphragm protrusion 322 around its own center axis during the assembly process, and facilitate the fixing of the diaphragm protrusion 322 to the balance wheel.

When the diaphragm is working, the contact friction between the diaphragm and the middle piece will affect the life of the diaphragm. Referring to FIG. 4*a*, the thickness of the portion of the diaphragm body 321 that contacts the through hole of the middle piece 33 (i.e., in the dotted line circular) may be made greater than the thickness of the rest of the diaphragm. The increased thickness of the diaphragm at the contact portion can offset the influence of the contact friction to increase the life of the diaphragm.

Figure 5:
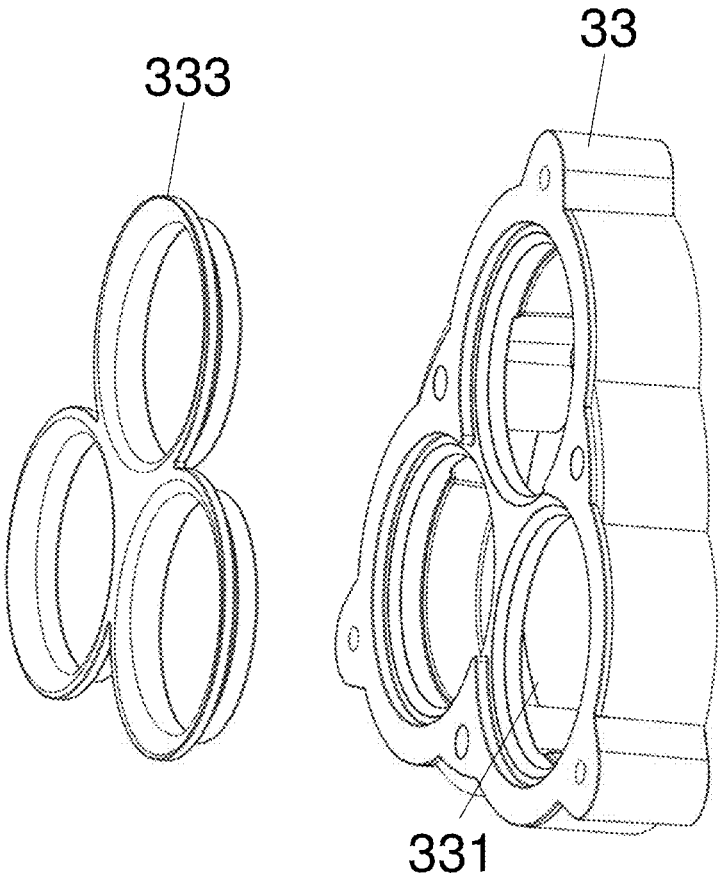
FIG. 5 illustrates a middle piece and a gasket in an embodiment of the present invention.

FIG. 5 illustrates the structure of the middle piece and the gasket according to an embodiment of the present invention. The left side of the middle piece 33, that is, the edge of the first through hole, may be provided with a step. The diaphragm assembly may further include a gasket 333. The gasket 333 is located between the diaphragm 32 and the middle piece 33. The structure of the gasket 333 is compatible with the diaphragm 32 and the middle piece 33. For example, the gasket 333 is a structure formed of three circular rings, which may be placed on the stepped hole on the surface of the middle piece 33, and the gasket 333 may also be in contact with the bottom of the three disks of the diaphragm 32. The gasket 333 may be made of polytetrafluoroethylene material, which has a lubricating function between the diaphragm and the middle piece, thereby increasing the life of the diaphragm.

Figure 6:
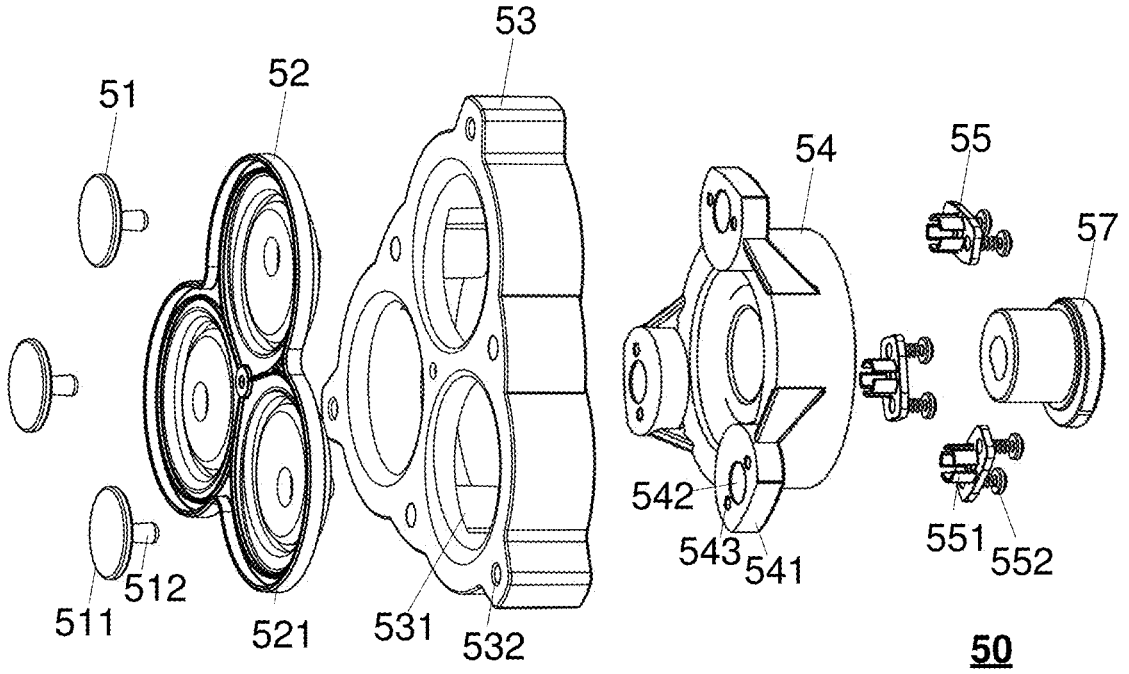
FIG. 6 is a perspective exploded view of diaphragm assembly 50 according to an embodiment of the present invention.

FIG. 6 shows a perspective exploded view of a diaphragm assembly 50 of an embodiment of the present invention.

Figure 7:
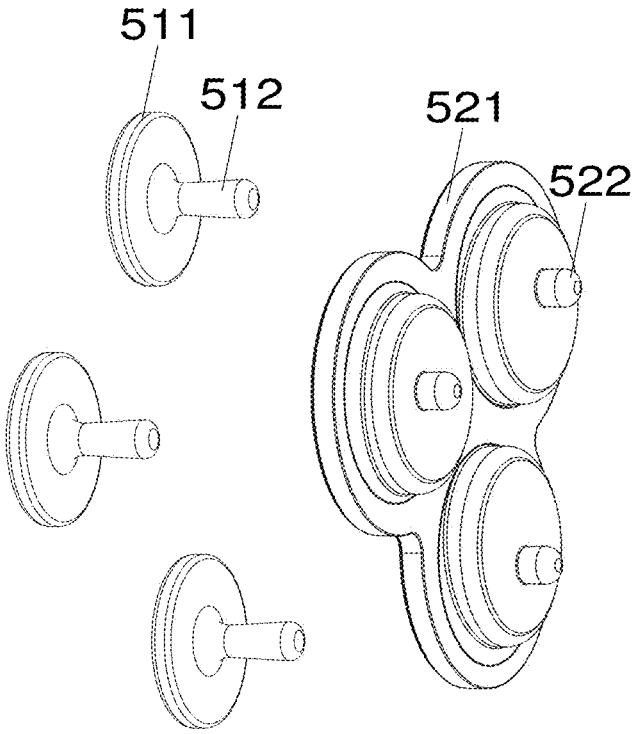
FIG. 7 is a perspective exploded view of a piston push block and diaphragm of the diaphragm assembly 50 according to an embodiment of the present invention.

FIG. 7 shows a perspective exploded view of a piston push block and a diaphragm in the diaphragm assembly 50. As shown in FIG. 6, the diaphragm assembly 50 includes three piston push blocks 51, a diaphragm 52, a middle piece 53, a balance wheel seat 54, and three fasteners 55 arranged from the pump head to the pump tail, that is, from left to right in the figure. The diaphragm assembly 50 may also be equipped with an eccentric cam 57.

Compared with the diaphragm assembly 30, the difference between the diaphragm assembly 50 lies in the structure of the fastener 55 and the fixing method between the piston push blocks 51, the middle piece 53, the balance wheel seat 54 and the fasteners 55, which will be described in detail below. The parts of the diaphragm assembly 50 similar to those of the diaphragm assembly 30 are briefly described or not repeated.

Each piston push block 51 includes a piston head 511 and a piston shaft 512. The piston head 511 is located on the side of the diaphragm 52 facing away from the middle piece 55, that is, the left side of the diaphragm 52 in the figure. The piston shaft 512 is on the side of the piston head 511 closer to the diaphragm 52. The piston shaft 512 extends from the piston head 511 toward the diaphragm 52. The diaphragm 52 includes a diaphragm body 521 and three diaphragm protrusions 522. In the diaphragm assembly 50, the diaphragm body 521 includes three disks, which are approximately shaped like a triangle with three disks arranged as three vertices, so there are 3 diaphragm chambers in the working area.

The diaphragm body 521 is provided with three diaphragm protrusions 522. Each diaphragm protrusion is located in its own disk, and protrudes toward the direction of the middle piece 53 and extends into the corresponding balance wheel of the balance wheel seat 54. The size of the diaphragm protrusion 522 matches the size of the piston shaft 512. Each piston shaft 512 is embedded in the corresponding diaphragm protrusion 522. The diaphragm body 521 and the diaphragm protrusion 522 may be integrally formed. It should be noted that both the piston shaft 512 and the diaphragm protrusion 522 are structures without any holes.

The middle piece 53 is a support for the diaphragm assembly 50. The middle piece 53 has three equally spaced through holes 531 (first through holes). The periphery of the middle piece has evenly spaced fixing holes 532. These fixing holes 532 cooperate with corresponding fixing holes (not shown) on the pump head cover 10 to fix the pump head cover 10 and the diaphragm assembly 50.

The balance wheel seat 54 has three balance wheels 541. The surrounding walls of the middle piece 53 and the diaphragm 52 form a swinging chamber for the balance wheel to swing. Each balance wheel 541 has an insertion hole 542 for the corresponding diaphragm protrusion 522 of the diaphragm to be inserted. In addition, two threaded holes 543 (second threaded holes) are provided around the insertion hole 542.

Each fastener 55 includes a claw structure 551 and screws 552. The claw structure 551 includes a circle of sheet structures, which may pass through the insertion hole 542 and be inserted between the diaphragm protrusion and the insertion hole. When the screws 552 around the claw structure 551 are screwed into the threaded holes 543, the screws compress the sheet structure of the claw structure toward its center, thereby pinching the diaphragm protrusion. The fastener 55 passes through the insertion hole 542 in the direction toward the pump head, thereby fixing the piston push block 51 and the diaphragm 52 to the balance wheel 541.

In FIG. 6-7, a piston push block is disposed on the working surface of the diaphragm 52, and the piston head of the piston push block abuts the diaphragm body, while the piston shaft of the piston push block is inserted in the diaphragm protrusion of the diaphragm. The fastener is inserted from the right side of the insertion hole of the balance wheel seat, and fixes the piston push block, the diaphragm and the balance wheel seat together. The fastener is located on the non-working surface of the diaphragm, so it does not need to contact the liquid, which minimizes the risk of rust or corrosion of the screws, and it can prevent liquid from leaking into the non-working area of the diaphragm, thereby improving the safety and life of the diaphragm pump.

In some examples, the piston push block 51 may also be provided with protrusions (not shown in the figure) on the side facing the diaphragm 52. Correspondingly, recesses may be provided on the working surface of the diaphragm body 521. In addition, a groove may also be provided on the front side of the piston push block 51 for clamping by an external clamping tool during assembly. In some examples, three gaskets may be provided between the middle piece 53 and the balance wheel seat 54, and each gasket has a through hole for the diaphragm protrusion of the diaphragm to be inserted, thereby preventing wear of the diaphragm.

Figure 8A:
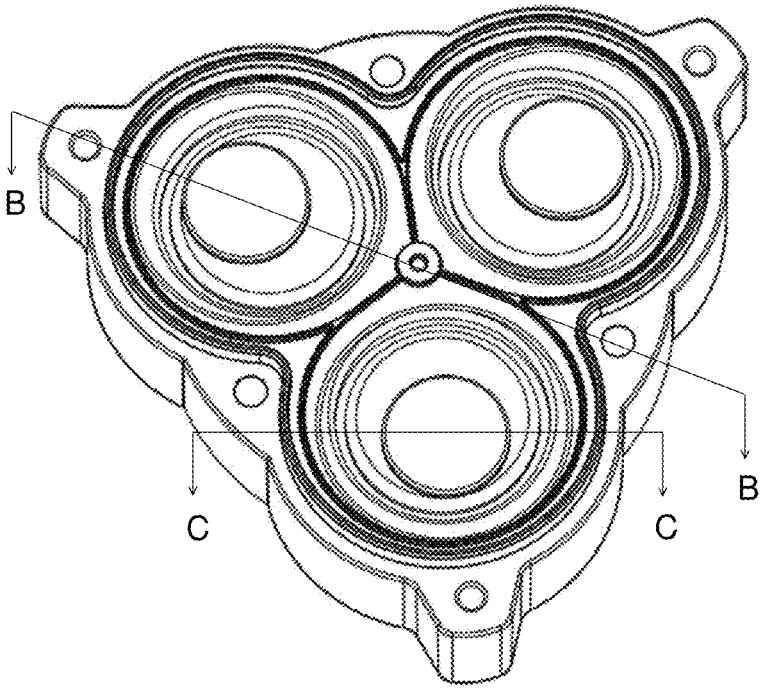
FIG. 8*a* is a front plan view of the assembled diaphragm assembly 50 according to an embodiment of the present invention.
Figure 8B:
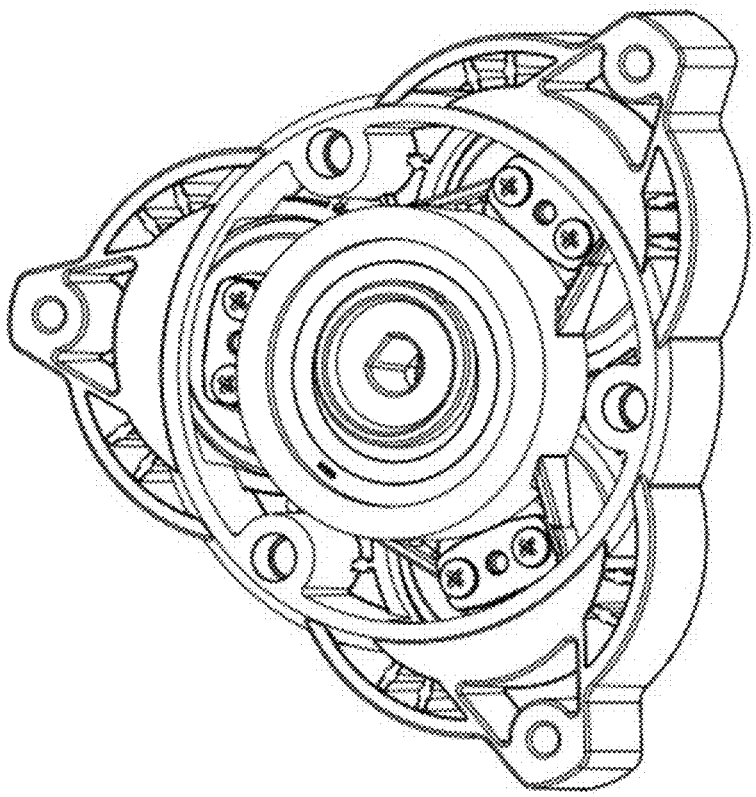
FIG. 8*b* is a perspective view of the assembled diaphragm assembly 50 according to an embodiment of the present invention.
Figure 9A:
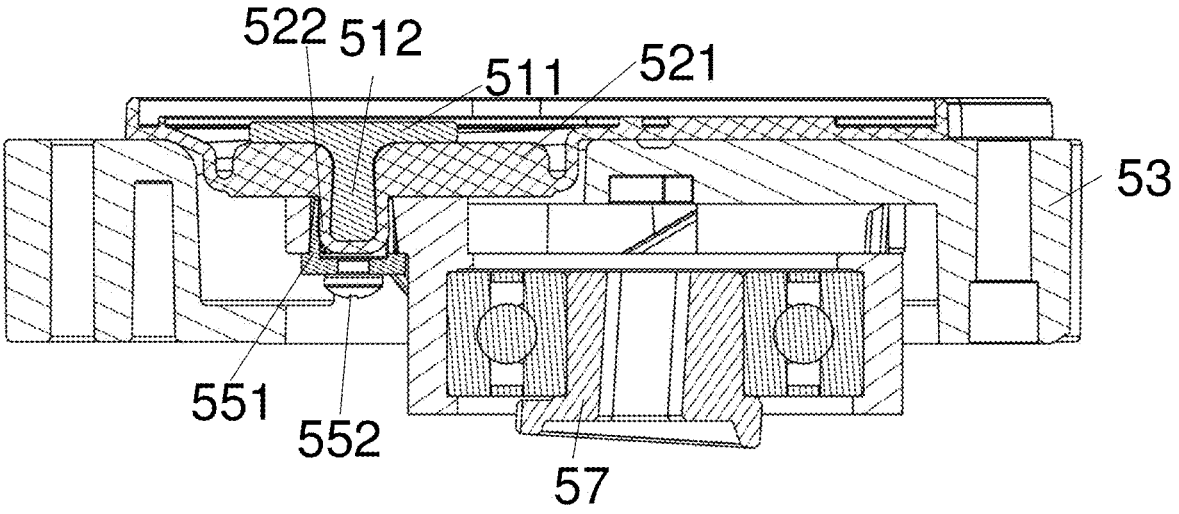
FIG. 9*a* is a cross-sectional view of the diaphragm assembly 50 of FIG. 8*a* taken along the line BB.
Figure 9B:
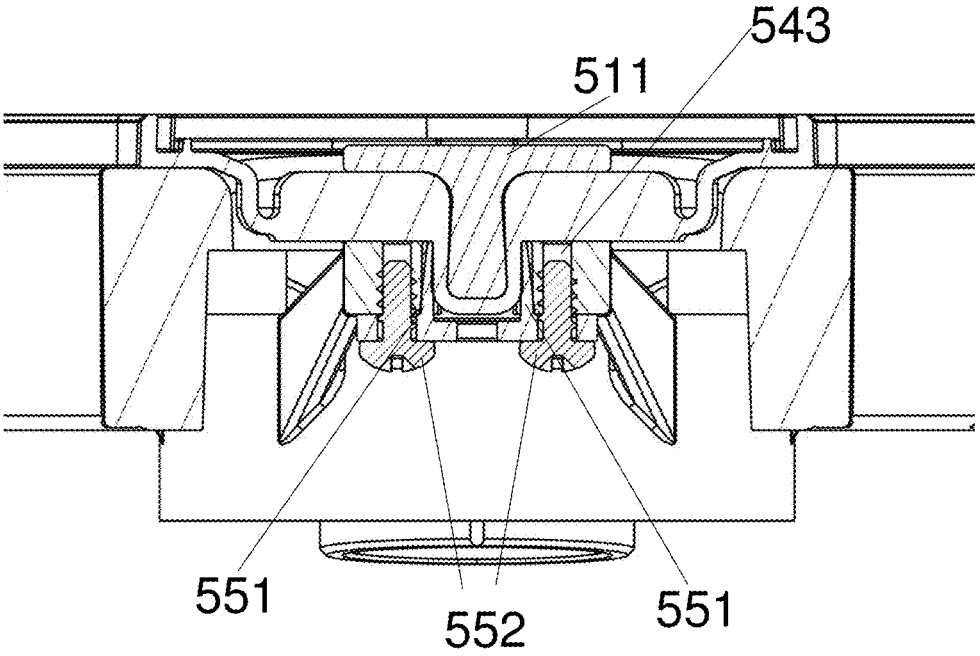
FIG. 9*b* is a cross-sectional view of the diaphragm assembly 50 of FIG. 8*a* taken along the line CC.

FIG. 8*a* shows a front view of the diaphragm assembly 50 after assembly, which shows the front side of the diaphragm assembly. FIG. 8*b* shows a perspective view of the diaphragm assembly 50 after assembly, which shows the back side of the diaphragm assembly 50. FIG. 9*a* shows a cross-sectional view of the diaphragm assembly 50 in FIG. 8*a* taken along the BB direction. FIG. 9*b* shows a partial cross-sectional view of the diaphragm assembly 50 in FIG. 8*a* taken along the CC direction.

The balance wheel 54 may be made of plastic and has a certain elasticity. As shown in FIGS. 9*a* and 9*b*, when the screw 552 is screwed into the threaded hole 543, the surroundings of the threaded hole 543 are squeezed outward, thereby applying pressure to the adjacent claw structure 551. The claw structure 551 applies pressure from the surroundings of the end of the diaphragm protrusion 522 to the center of the diaphragm protrusion, thereby fixing the diaphragm protrusion and the piston shaft 512 therein. In addition, the outside of the piston shaft 512 and the inside of the diaphragm protrusion 522 are shaped in a small middle part and a large end part in their respective extension directions. This makes it easier for the claw structure to grab it.

Each fastener 55 in the diaphragm assembly 50 includes two screws. It is understood that in order to improve the fixing force, the fastener may also include a larger number of screws. For example, the fastener includes four screws, which are distributed around the claw structure.

Because the diaphragm assembly 50 does not have a hole in the diaphragm, the diaphragm chamber at the working surface of the diaphragm and the part at the non-working surface are completely isolated from each other, thereby preventing liquid leakage and having better sealing performance. In addition, since the diaphragm itself has no gaps, the diaphragm pump may automatically suck in the medium (liquid) in the absence of the medium, without the need for an additional suction device or pre-filling. Therefore, the diaphragm pump may also be run dry for a short period of time.

The assembly process of the diaphragm assembly 50 may be as follows: The balance wheel seat 54 is assembly on the middle piece 53, and the balance wheel 541 is inserted into the swing chamber of the middle piece and then fixed. Each diaphragm protrusion 522 on the diaphragm 52 is aligned with the insertion hole 542 of the balance wheel 541, and the diaphragm 52 is tightly fitted with the balance wheel 541; after each piston push block 51 is aligned with the diaphragm protrusion 522, the piston head 511 is pushed to make the piston shaft 512 enter the diaphragm protrusion 522; each screw 552 is inserted into the corresponding threaded hole 543 of the balance wheel, the claw-type structure 551 is squeezed, and finally the piston push block, the diaphragm, and the balance wheel seat are fixed.

The diaphragm assembly of the present invention may be applied to a diaphragm pump. The present invention also discloses a diaphragm pump. The diaphragm pump may be described with reference to FIG. 1. The diaphragm pump includes a pump head cover 10, a piston valve body 20, an eccentric cam 37, a motor located in a base 40, and a diaphragm assemblies according to any of the embodiments described above. The eccentric cam 37 is assembled in the diaphragm assembly, and the motor is connected to the eccentric cam and drives the eccentric cam to rotate.

While various embodiments are described above, the present invention is not limited to these embodiments. For those skilled in the art, the embodiments of the present invention may have various changes and variations. Any modification, equivalent replacement, improvement, etc. made within the spirit and principle of the embodiment of the present invention are within the scope of the present invention.

Although the embodiments of the present invention have been described, it should be understood that the present invention is not limited to the disclosed specific embodiments. The embodiments of the present invention are intended to cover various modifications and equivalent arrangements included in the spirit and scope of the appended claims. The scope of the appended claims should be given the broadest reasonable interpretation, and cover all such modifications and equivalent structures and functions.

The invention claimed is:

1. A diaphragm assembly, comprising:

a piston push block;

a diaphragm;

a middle piece;

a balance wheel seat; and at least one fastener, wherein the diaphragm includes a diaphragm body and a diaphragm protrusion formed on the diaphragm body, wherein the diaphragm protrusion protrudes toward the middle piece and extends into the balance wheel seat;

wherein the piston push block includes a piston head and a piston shaft arranged on a side of the piston head closer to the diaphragm, the piston head is located on a side of the diaphragm facing away from the middle piece, the piston shaft extends toward the diaphragm, and the piston shaft is embedded in the diaphragm protrusion;

wherein the middle piece has a first through hole, wherein the balance wheel seat has a balance wheel, and the balance wheel has an insertion hole for the diaphragm protrusion to be inserted therein; and wherein one of the at least one fasteners is configured to affix the piston push block, the diaphragm and the balance wheel seat from the side facing away from the working surface of the diaphragm.

2. The diaphragm assembly of claim 1, wherein the diaphragm protrusion has a second through hole at a distal end thereof, wherein a first threaded hole is provided inside the piston shaft, and wherein the one of the at least one fasteners is configured to pass through the second through hole and connect with the first threaded hole.

3. The diaphragm assembly of claim 2, wherein the piston head has a first annular protruding strip arranged around the piston shaft on a side facing the diaphragm.

4. The diaphragm assembly of claim 2, wherein the piston shaft has a second annular protruding strip on an outer surface thereof.

5. The diaphragm assembly of claim 2, wherein outer diameters of the piston shaft and the diaphragm protrusion gradually decrease along their extension directions.

6. The diaphragm assembly of claim 1, wherein the diaphragm protrusion is free of holes, wherein the balance wheel seat further includes a second threaded hole, wherein the one of the at least one fasteners includes a claw structure and screws, the claw structure is configured to pass through the insertion hole and clamp the diaphragm protrusion, and the screws are configured to compress the claw structure toward a center of the claw structure when being screwed into the second threaded hole.

7. The diaphragm assembly of claim 6, wherein the piston shaft and the diaphragm protrusion are shaped in an extending direction such that a middle portion is smaller in diameter than a distal end portion.

8. The diaphragm assembly of claim 1, wherein a protruding part is formed on a surface of the piston head facing the diaphragm, and a recesses is formed on a surface of the diaphragm body.

9. The diaphragm assembly of claim 1, wherein the piston head has two grooves on a front surface configured to allow a tool to clamp the piston push block.

10. The diaphragm assembly of claim 1, further comprising a gasket between the middle piece and the balance wheel seat, wherein the gasket has a third through hole configured for the diaphragm protrusion to be inserted.

11. The diaphragm assembly of claim 1, wherein a cross section of the diaphragm protrusion is a non-circular shape.

12. The diaphragm assembly of claim 1, wherein the diaphragm body includes a disk, and the diaphragm protrusion is located at a position on the disk that deviates from a center of the disk and is closer to an edge of the diaphragm body.

13. The diaphragm assembly of claim 1, wherein a thickness of a portion of the diaphragm contacting an edge of the first through hole is greater than a thickness of remaining portions of the diaphragm.

14. The diaphragm assembly of claim 1, wherein an edge of the first through hole of the middle piece has a step, and wherein the diaphragm assembly further includes a gasket arranged on the step, wherein the gasket is made of a polytetrafluoroethylene material.

15. The diaphragm assembly of claim 1, wherein the diaphragm body and the diaphragm protrusion are integrally formed, and wherein the diaphragm is made of an elastic material.

16. The diaphragm assembly of claim 1, wherein the piston push block is made of nylon and glass fiber materials.

17. A diaphragm pump, comprising:

a pump head cover;

a piston valve body;

an eccentric cam;

a motor; and the diaphragm assembly of claim 1, wherein the eccentric cam is installed in the diaphragm assembly, and the motor is connected to the eccentric cam and configured to drive the eccentric cam to rotate.

* * * * *